US005290985A

United States Patent [19]

Jancic et al.

[11] Patent Number: 5,290,985

[45] Date of Patent: Mar. 1, 1994

[54] MICROWAVE OVEN INSERT

[76] Inventors: Betsy L. Jancic; Dale A. Jancic, both of 17 Harvard La., Bedford, N.H. 03110

[21] Appl. No.: 24,279

[22] Filed: Mar. 1, 1993

[51] Int. Cl.[5] ..... H05B 6/80

[52] U.S. Cl. ..... 219/725; 219/756; 99/DIG. 14

[58] Field of Search ..... 219/10.55 E, 10.55 F, 219/10.55 R, 392; 99/DIG. 14

[56] References Cited

U.S. PATENT DOCUMENTS 2,888,542 5/1959 Mork ..... 219/10.55 E
4,080,524 3/1978 Greenfield, Jr. et al. ... 219/10.55 E
4,122,324 10/1978 Falk ..... 219/10.55 E
4,481,395 11/1984 Smith et al. ..... 219/10.55 E
4,633,052 12/1986 Beavers et al. ..... 219/10.55 E
4,778,968 10/1988 Torres ..... 219/10.55 E

*Primary Examiner*—Philip H. Leung
*Attorney, Agent, or Firm*—Leon Gilden

[57] ABSTRACT

An insert formed of a polymeric microwave transmissible material is arranged for complementary reception with the microwave oven cavity permitting ease of removal of the insert relative to the cavity for enhanced ease of cleaning of the insert relative to and subsequent a microwave oven cooking procedure.

2 Claims, 4 Drawing Sheets

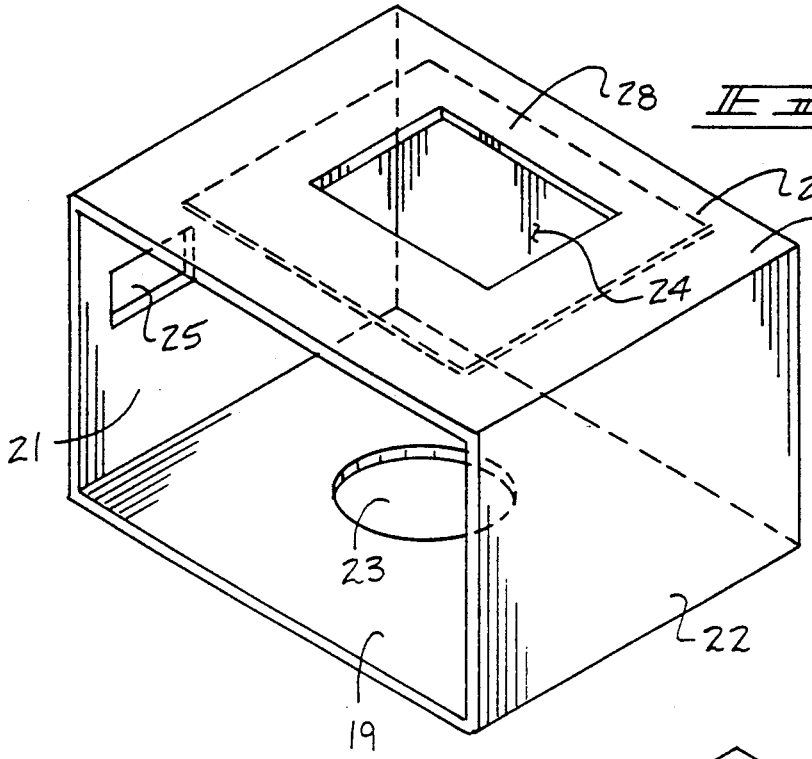
FIG 3
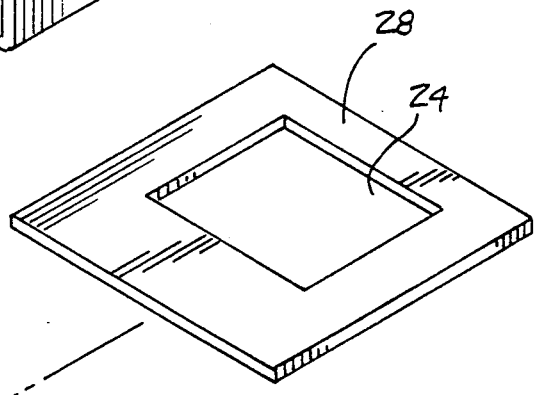
FIG 4
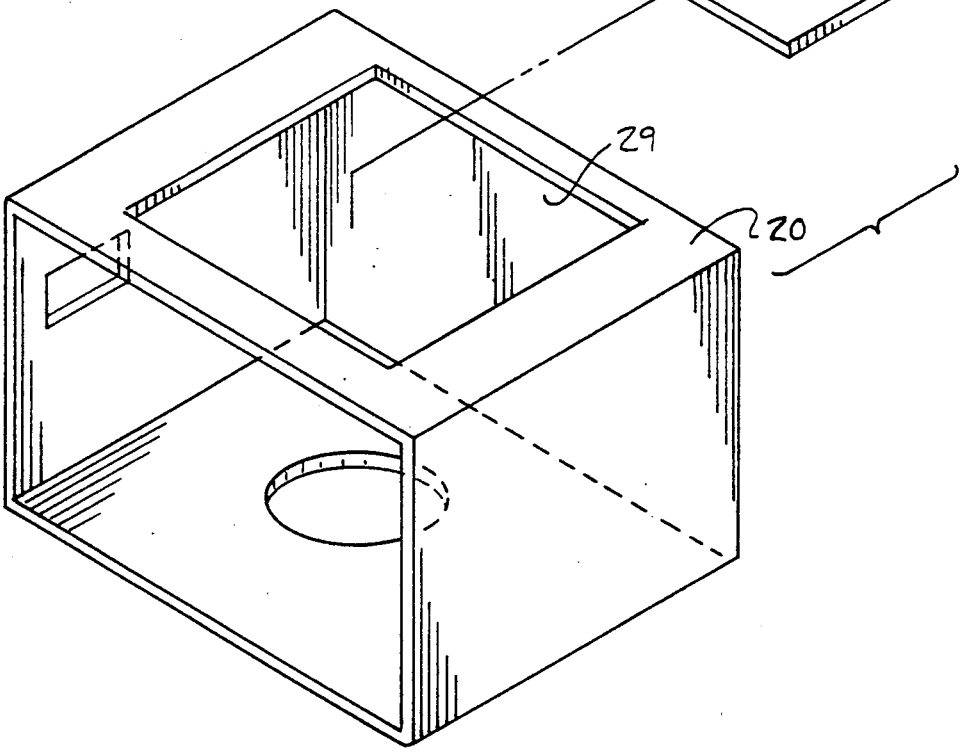

MICROWAVE OVEN INSERT

BACKGROUND OF THE INVENTION

1. Field of the Invention

The field of invention relates to microwave oven structure, and more particularly pertains to a new and improved microwave oven insert wherein the same is arranged for reception within a microwave oven permitting ease of its removal for subsequent cleaning.

2. Description of the Prior Art

Microwave oven cleaning due to the fixed configuration has typically been of concern, wherein U.S. Pat. Nos. 4,633,052 and 4,778,968 set forth liner apparatus arranged for positioning within a microwave oven structure of a typical bag-like configuration and construction for enhanced ease of cleaning of a microwave oven.

The instant invention attempts to overcome deficiencies of the prior art by providing for a unitary insert housing member arranged for positioning within a microwave oven permitting ease of cleaning and removal of the liner relative to the microwave oven in a manner not addressed by the prior art and in this respect, the present invention substantially fulfills this need.

SUMMARY OF THE INVENTION

In view of the foregoing disadvantages inherent in the known types of microwave oven insert, structure now present in the prior art, the present invention provides a microwave oven insert including a unitary container having selective openings through the floor, roof, and at least one side wall for access of microwave oven components within the container structure. As such, the general purpose of the present invention, which will be described subsequently in greater detail, is to provide a new and improved microwave oven insert which has all the advantages of the prior art microwave oven insert and none of the disadvantages.

To attain this, the present invention provides an insert formed of a polymeric microwave transmissible material arranged for complementary reception with the microwave oven cavity permitting ease of removal of the insert relative to the cavity for enhanced ease of cleaning of the insert relative to and subsequent a microwave oven cooking procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved microwave oven insert which has all the advantages of the prior art microwave oven insert and none of the disadvantages.

It is another object of the present invention to provide a new and improved microwave oven insert which may be easily and efficiently manufactured and marketed.

It is a further object of the present invention to provide a new and improved microwave oven insert which is of a durable and reliable construction.

An even further object of the present invention is to provide a new and improved microwave oven insert which is susceptible of a low cost of manufacture with regard to both materials and labor, and which accordingly is then susceptible of low prices of sale to the consuming public, thereby making such microwave oven insert economically available to the buying public.

Still yet another object of the present invention is to provide a new and improved microwave oven insert which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the invention arranged to include a frangible junction permitting removal of a roof plate relative to the roof structure of the invention.

FIG. 4 is an isometric illustration of the invention indicating the roof plate removed relative to the roof portion of the container.

DESCRIPTION OF THE PREFERRED EMBODIMENT

Figure 1:
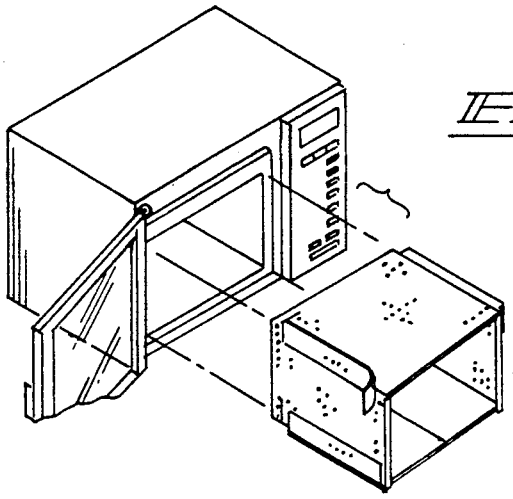
FIG 1 PRIOR ART
FIG. 1 is an isometric illustration of a prior art microwave oven insert, as indicated in U.S. Pat. No. 4,633,052, formed as a disposable liner member arranged for interfolding.
Figure 2:
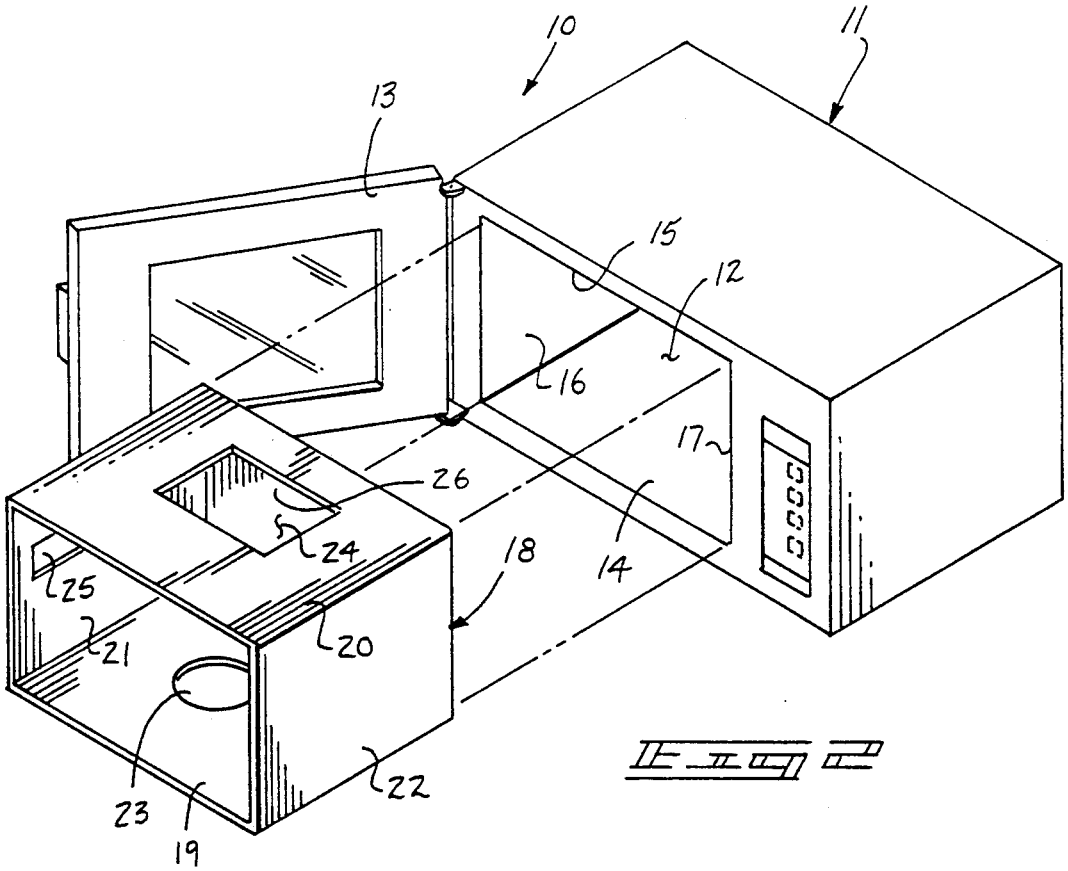
FIG. 2 is an isometric illustration of the invention.

With reference now to the drawings, and in particular to FIGS. 1 to 8 thereof, a new and improved microwave oven insert embodying the principles and concepts of the present invention and generally designated by the reference numeral 10 will be described.

More specifically, the microwave oven insert 10 of the invention essentially comprises cooperation with a microwave oven 11, having a cooking cavity 12 accessed through a microwave oven door 13. The cooking cavity includes a cooking cavity floor 14, a cooking cavity roof 15, and cooking cavity respective first and second side walls 16 and 17.

An insert container 18 is provided, having an insert floor 19 spaced from an insert roof plate 20, with respective insert first and second side walls 21 and 22, as well as an insert rear wall 26. The insert floor 19 includes a floor aperture 23 arranged to receive a turn table structure therethrough, with the roof plate 20 having a roof plate wave access opening 24 directed therethrough. The first side wall 21 is arranged to have a first side wall light opening 25.

The FIGS. 3 and 4 indicates the use of a roof plate insert 28 coplanar with the roof plate 20 and connected therewithin by continuous frangible junction 27 that is arranged in surrounding relationship relative to the roof wave access opening 24. In this manner, the roof plate insert 28 is removed permitting mounting of venting structure relative to the microwave oven roof 15.

Figure 5:
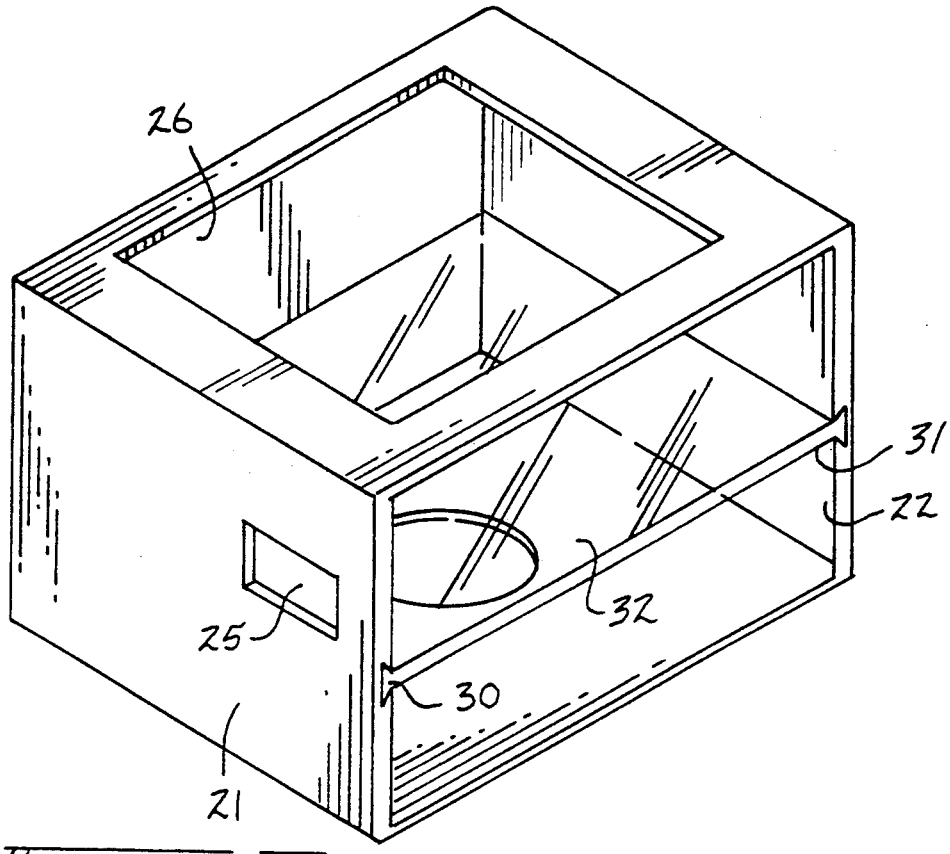
FIG. 5 is an isometric illustration of the invention employing a shelf plate.
Figure 6:
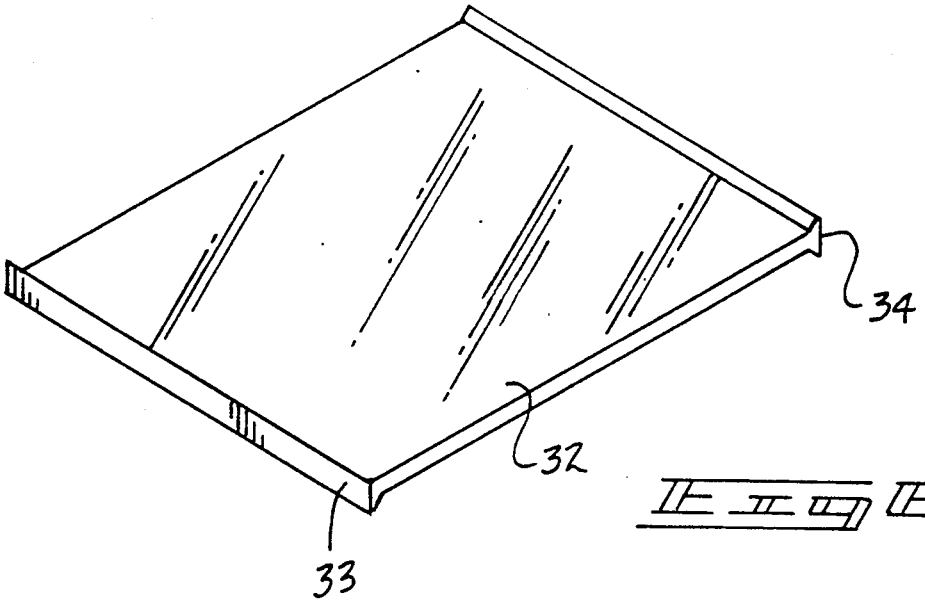
FIG. 6 is an isometric illustration of the shelf plate.

The FIG. 5 indicates the use of the insert first and second side walls 21 and 22 having respective first and second dove tail slots 30 and 31 arranged in a parallel coextensive relationship relative to one another spaced an equal distance relative to the insert floor 19 permitting reception of a transparent shelf plate 32 intermediate and parallel the insert floor and roof plate portions. The transparent shelf plate 32 is arranged to include respective first and second dove tail side walls 33 and 34 arranged for sliding reception within respective first and second dove tail slots 30 and 31.

Figure 7:
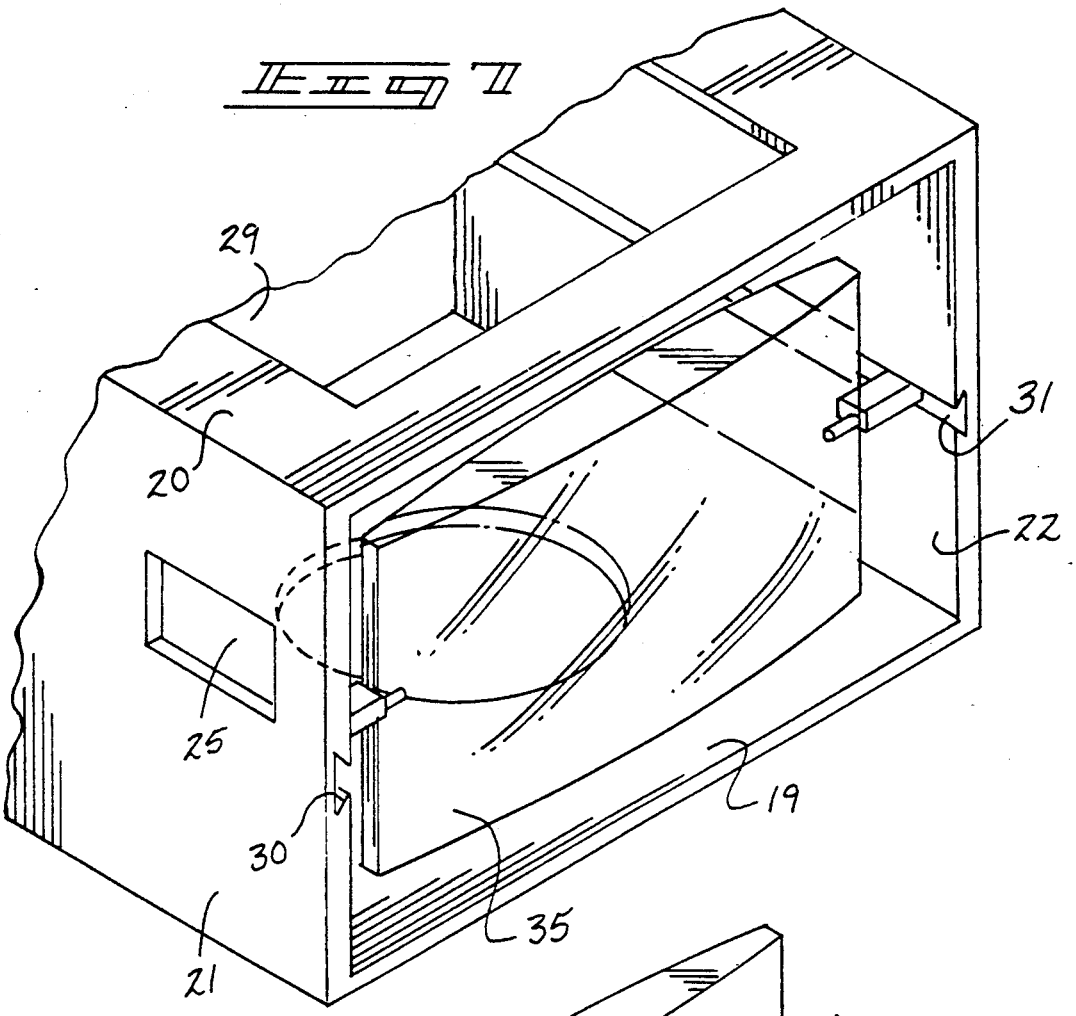
FIG. 7 is an isometric illustration of the invention employing a magnification lens.
Figure 8:
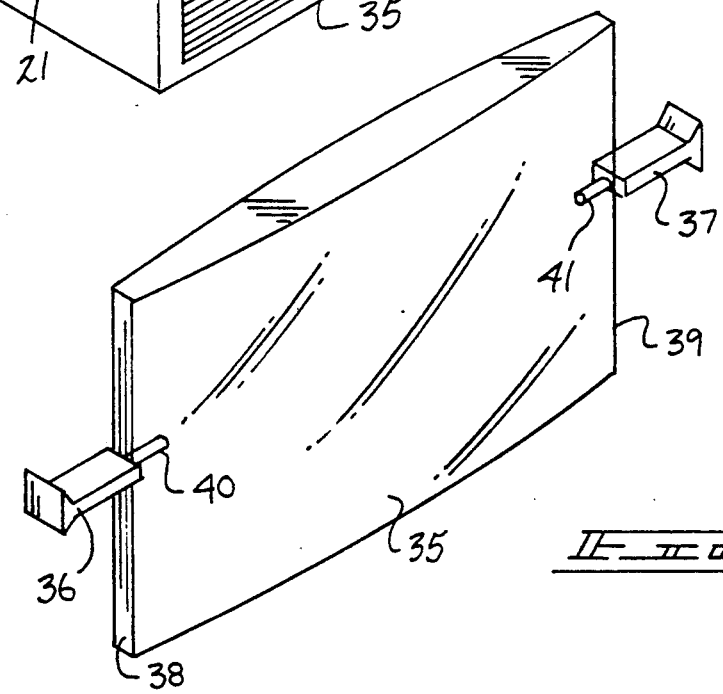
FIG. 8 is an isometric illustration of the magnification lens.

The FIGS. 7 and 8 indicate the use of a magnification lens 35 having respective first and second dove tail legs 36 and 37 extending orthogonally relative to the lens' first and second side walls 38 and 39 that are arranged in a parallel relationship relative to one another. The first and second dove tail legs 36 and 37 include respective first and second leg axles 40 and 41 that are mounted intermediate of and rotatably relative to the lens' first and second side walls 38 and 39 to permit pivoting of the magnification lens for proper viewing of a food component within the insert container 18.

In this manner, the insert container is arranged for ease of removal relative to the microwave oven cooking cavity 12 permitting its ease of cleaning and sanitizing for continued use. In this manner, it should be understood that the insert container 18 is formed of a rigid material and as noted, of a polymeric construction.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A microwave oven insert arranged for reception within a microwave oven, wherein the insert comprises, a floor and a roof plate spaced from and parallel relative to the floor, a first side wall spaced from and parallel a second side wall, and a rear wall, and an entrance opening directed into the insert container between the roof plate, the floor, the first side wall, the second side wall, and wherein the insert is formed of a polymeric microwave transmissible material, and the first side wall having a first side wall opening arranged to permit alignment with illumination within a microwave oven, and the roof plate having a roof plate opening arranged to receive microwave therethrough, and the floor having a floor opening arranged to accommodate a turn table through the floor, and the roof plate includes a continuous frangible junction extending in surrounding relationship relative to the roof plate opening, wherein rupture of the frangible junction permits removal of a roof plate insert oriented within the frangible junction to accommodate venting from the insert through the microwave oven, and a first dovetail slot directed coextensively along the first side wall spaced a predetermined spacing relative to the floor, and a second dovetail slot directed into the second side wall in facing relationship relative to the first dovetail slot, wherein the second dovetail slot is spaced said predetermined spacing relative to the floor, and the first dovetail slot and the second dovetail slot are arranged in a parallel coextensive relationship, and a transparent shelf plate, the transparent shelf plate including a first dovetail side wall and a second dovetail side wall, wherein the first dovetail side wall is arranged for reception within the first dovetail slot and the second dovetail side wall is arranged for simultaneous reception within the second dovetail slot.

2. An insert as set forth in claim 1 including a magnification lens, the magnification lens including a lens first side wall spaced from a lens second side wall, and a first dovetail leg orthogonally oriented relative to the lens first side wall, and a second dovetail leg orthogonally oriented relative to the lens second side wall, wherein the first dovetail leg includes a first leg axle directed rotatably and medially of the lens first side wall, and the second dovetail leg includes a second leg axle directed orthogonally, medially, and rotatably into the lens second side wall permitting rotation of the magnification lens when the first dovetail leg and the second dovetail leg are received within the first dovetail slot and the second dovetail slot.

* * * * *